US007115346B2

(12) United States Patent
Yokota et al.

(10) Patent No.: US 7,115,346 B2
(45) Date of Patent: Oct. 3, 2006

(54) MULTI-LAYERED ELECTROPHOTOGRAPHIC POSITIVELY CHARGED ORGANIC PHOTOCONDUCTOR AND MANUFACTURING METHOD THEREOF

(75) Inventors: Saburo Yokota, Suwon (KR); Kyung-yol Yon, Seongnam (KR); Hwan-koo Lee, Suwon (KR); Hae-ree Joo, Seoul (KR); Boem-jun Kim, Seongnam (KR); Nam-jeong Lee, Seoul (KR)

(73) Assignee: Samsung Electronics Co., LTD, Suwon-si (KR)

( * ) Notice: Subject to any disclaimer, the term of this patent is extended or adjusted under 35 U.S.C. 154(b) by 148 days.

(21) Appl. No.: 10/674,786

(22) Filed: Oct. 1, 2003

(65) Prior Publication Data

US 2004/0121251 A1 Jun. 24, 2004

(30) Foreign Application Priority Data

Oct. 2, 2002 (KR) ..... 10-2002-0060013

(51) Int. Cl.
*G03G 15/02* (2006.01)

(52) U.S. Cl. ..... 430/58.45; 430/58.05; 430/59.1; 430/58.85; 430/127; 430/132; 430/133

(58) Field of Classification Search ..... 430/58.45, 430/58.05, 59.1, 58.85, 127, 132, 133
See application file for complete search history.

(56) References Cited

U.S. PATENT DOCUMENTS

| | | | | |
|---|---|---|---|---|
| 4,547,447 | A | 10/1985 | Ueda | |
| 4,663,259 | A | 5/1987 | Fujimura et al. | |
| 5,013,623 | A | 5/1991 | Itoh et al. | |
| 5,114,815 | A | 5/1992 | Oda et al. | |
| 5,187,036 | A * | 2/1993 | Matsui et al. | 430/58.4 |
| 5,395,722 | A | 3/1995 | Nukada et al. | |
| 5,418,107 | A | 5/1995 | Nealey et al. | |
| 5,496,672 | A | 3/1996 | Akimoto et al. | |
| 5,721,082 | A | 2/1998 | Takesue et al. | |
| 5,891,594 | A | 4/1999 | Yuh et al. | |
| 6,331,371 | B1 * | 12/2001 | Matsui | 430/65 |
| 6,372,397 | B1 | 4/2002 | Maruyama et al. | |

FOREIGN PATENT DOCUMENTS

| | | |
|---|---|---|
| JP | 5-19520 | 1/1993 |
| JP | 05-297615 | 11/1993 |

(Continued)

OTHER PUBLICATIONS

Japanese Office Action issued Apr. 26, 2005 in Japanese Patent Application No. 2003-344848.

(Continued)

*Primary Examiner*—Mark A. Chapman
(74) *Attorney, Agent, or Firm*—Staas & Halsey LLP

(57) ABSTRACT

A multi-layered electrophotographic positively charged organic photoconductor includes a conductive substrate, a charge transport layer formed on the conductive substrate, and a charge generating layer formed on the charge transport layer. A composition to form the charge transport layer includes at least one hole transport material, a binder resin and an organic solvent, and a composition to form the charge generating layer includes a charge generating material, a binder resin, an organic solvent and a hole transport material. An organic photoconductor has improved static electrical properties by controlling interfacial conditions of the charge transport layer and the charge generating layer. The charge generating layer may be readily coated on the charge transport layer. In addition, the organic photoconductor has excellent electric properties such as an improved sensitivity and a low discharge voltage.

11 Claims, 3 Drawing Sheets

FOREIGN PATENT DOCUMENTS

| | | | |
|---|---|---|---|
| JP | 06083118 | A | 3/1994 |
| JP | 06-118664 | | 4/1994 |
| JP | 06-3375252 | | 12/1994 |
| JP | 7-253679 | | 10/1995 |
| JP | 2000-066422 | | 3/2000 |

OTHER PUBLICATIONS

Patent Abstracts of Japan, Publication No. 02-051162, Published Feb. 21, 1990.

Patent Abstracts of Japan, Publication No. 10-020524, Published Jan. 23, 1998.

Patent Abstracts of Japan, Publication No. 10-069107, Published Mar. 10, 1998.

Patent Abstracts of Japan, Publication No. 10-148952, Published Jun. 2, 1998.

Patent Abstracts of Japan, Publication No. 11-095459, Published Apr. 9, 1999.

Patent Abstracts of Japan, Publication No. 11-258839, Published Sep. 24, 1999.

Patent Abstracts of Japan, Publication No. 11-265081, Published Sep. 28, 1999.

Patent Abstracts of Japan, Publication No. 60-237453, Published Nov. 26, 1985.

Patent Abstracts of Japan, Publication No. 62-116943, Published May 28, 1987.

Patent Abstracts of Japan, Publication No. 2000-147804, Published May 26, 2000.

Patent Abstracts of Japan, Publication No. 2002-023396, Published Jan. 23, 2002.

Patent Abstracts of Japan, Publication No. 2002-040693, Published Jun. 2, 2002.

Patent Abstracts of Japan, Publication No. 2002-174921, Published Jun. 21, 2002.

Patent Abstracts of Japan, Publication No. 2002-278099, Published Sep. 27, 2002.

Korean Office Action issued May 23, 2005 in Korean Patent Application No. 10-2002-0060013.

Japanese Office Action dated Mar. 29, 2005 in Japanese Patent Application No. 2003-35161 corresponding to U.S. Appl. No. 11/220,569 (see "List of Copending Applications" attached).

Diamond, Arthur S. & David Weiss (eds.), Handbook of Imaging Materials, New York: Marcel-Dekker, Inc. (Nov. 2001), pp. 145-164.

U.S. Appl. No. 11/220,569, filed Sep. 8, 2005, Lee et al.

* cited by examiner

MULTI-LAYERED ELECTROPHOTOGRAPHIC POSITIVELY CHARGED ORGANIC PHOTOCONDUCTOR AND MANUFACTURING METHOD THEREOF

CROSS-REFERENCE TO RELATED APPLICATIONS

This application claims the benefit of Korean Application No. 2002-60013, filed Oct. 2, 2002, in the Korean Intellectual Property Office, the disclosure of which is incorporated herein by reference.

BACKGROUND OF THE INVENTION

1. Field of the Invention

The present invention relates to a multi-layered electrophotographic positively charged organic photoconductor, and more particularly, a multi-layered electrophotographic positively charged organic photoconductor with superior electric properties, such as an improved sensitivity and a reduced discharge voltage in which a composition for forming a charge generating layer comprises a hole transport material, wherein charges may be readily injected to a charge transport layer.

2. Description of the Related Art

FIG. 1 illustrates a fundamental construction of a positively charged organic photoconductor used in the electrophotographic imaging process. As shown in FIG. 1, the multi-layered positively charged organic photoconductor has a structure comprising a charge transport layer (CTL) 20 and a charge generating layer (CGL) 30 sequentially coated on a conductive substrate 10. Since the charge generating layer 30 has a thin thickness, an overcoat layer (OCL) 40 may be coated thereon. Otherwise, the charge generating layer may be worn away by friction with a toner and a cleaning blade. Also, a charge blocking layer (not shown) may be provided to function as an adhesive and to block charges between the conductive substrate 10 and the charge transport layer 20.

The principle of forming an electrophotographic image using an organic photoconductor having the foregoing fundamental construction is as follows.

The surface of an organic photoconductor is positively charged by a charging device such as a corona. When a laser beam is irradiated on the charged organic photoconductor, positive charges (holes) and negative charges (electrons) are generated in the charge generating layer of the organic photoconductor. At this time, the positive charges are injected into the charge transport layer of the organic photoconductor by an electric field which has been previously applied to the organic photoconductor, and then migrate to the conductive substrate. On the other hand, the negative charges (electrons) migrate to the surface of the overcoat layer of the organic photoconductor to neutralize the surface charges. Thus, an exposed discharged part has its surface potential lowered to form a latent image, upon which a toner is developed to form an image on the surface of the organic photoconductor. The image thus obtained may be transferred to a receiver, such as paper or transferring products. The above electrophotographic process is repeated several times.

In the multi-layered positively charged organic photoconductor, the respective layers have roles different from each other, while a single-layered organic photoconductor satisfies a series of electric properties in a single layer. Therefore, it is much easier to design electric properties with respect to charge voltage and light exposure voltage with the multi-layered positive charged organic photoconductor. Also, an electric field may be stably applied to a multi-layered positive charged organic photoconductor in a thinly coated state, wherein the organic photoconductor may have a greater charge capacity. Thus, by using the multi-layered positively charged organic photoconductor, a wet toner having a large charge relative to a small particle size may be easily developed.

However, the multi-layered positively charged organic photoconductor has a disadvantage in that when a composition to form a charge generating layer is coated on a charge transport layer, an organic solvent in the composition may dissolve a part of the charge transport layer that is disposed under the charge generating layer. Consequently, the thickness of the charge transport layer may change, or substances making up the charge transport layer may be dissolved, which may cause a reduction in the charge transport capacity. Also, as the coating process is repeated, there are some problems including, for example, contamination of the composition that forms the charge generating layer.

To solve such problems, use of a solvent which does not dissolve any substance that forms the charge transport layer as an organic solvent in the composition to form a charge generating layer has been proposed. However, since such a method results in poor contact between charge generating material and charge transport material, charges generated in the charge generating layer by a laser beam cannot be injected to the charge transport layer effectively. Accordingly, the surface potential of an exposed part is not sufficiently low, and gradually increases when the photoconductor is repeatedly used.

SUMMARY OF THE INVENTION

Therefore, the present invention has been made in view of the above and/or other problems, and it is an aspect of the present invention to provide a multi-layered electrophotographic positively charged organic photoconductor with improved properties, including sensitivity and discharge voltage, in which an improved interface is provided between a charge generating layer and a charge transport layer, and charges generated by a laser beam may be readily injected into the charge transport layer.

It is another aspect of the present invention to provide a method to produce the multi-layered electrophotographic positive charged organic photoconductor according to the present invention.

In accordance with the present invention, the above and/or other aspects may be accomplished by the provision of a multi-layered electrophotographic positively charged organic photoconductor comprising a conductive substrate, a charge transport layer on the conductive substrate, and a charge generating layer on the charge transport layer, in which a composition to form the charge transport layer comprises a hole transport material, a binder resin and an organic solvent and a composition to form the charge generating layer comprises a charge generating material, a binder resin, an organic solvent and a hole transport material. Generally, the organic photoconductor may further comprise an overcoat layer on the charge generating layer.

Here, preferably, the hole transport material in the composition to form the charge transport layer is a stilbene compound having a structure of the following formula (I):

(I)

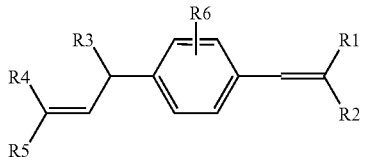

in which, R1 and R2 are independently selected from the group consisting of a hydrogen atom, an alkyl group, an aryl group, and a styryl group, provided that at least one of R1 and R2 is selected from an aryl group and a styryl group;

R3 is selected from the group consisting of a substituted or unsubstituted alkyl group, an aralkyl group and an aryl group;

R4 and R5 are independently selected from the group consisting of a hydrogen atom and an alkyl group; and R6 is selected from the group consisting of a hydrogen atom, a halogen atom, an alkyl group and an alkoxy group.

Also, the hole transport material in the composition to form the charge transport layer is preferably a hydrazone compound having a structure of the following formula (II):

(II)

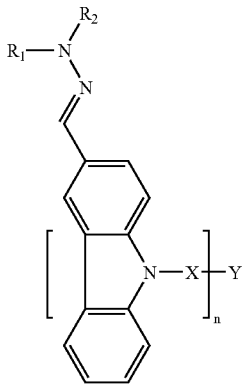

in which, n is an integer from 2 to 6;

$R_1$ and $R_2$ are independently selected from among an alkyl group, a cycloalkyl group, and an aryl group and optionally combined with the nitrogen atom to form a ring;

Y is selected from among a bond, a carbon atom, a —$CR_3$ group where $R_3$ is a hydrogen atom or an alkyl group or an aryl group, an aryl group, a cycloalkyl group, and a cyclosiloxyl group; and X is a linking group of the formula of —$(CH_2)_m$— where m is an integer from 4 to 10 and at least one methylene group is optionally substituted with an oxygen atom, a carbonyl group, or an ester group.

Preferably, the hole transport material in the composition to form the charge transport layer is a mixture of a stilbene compound of the formula (I) and a hydrazone compound of the formula (II).

Also, preferably, the binder resin in the composition to form the charge transport layer is polycarbonate, and the organic solvent in the composition to form the charge transport layer is tetrahydrofuran (THF).

Preferably, the organic solvent in the composition to form the charge generating layer is a mixture of an alcohol solvent and an acetate solvent, in which the acetate solvent is in the range of 10% by weight to 50% by weight based on the total weight of the solvent mixture.

The alcohol solvent is preferably selected from the group consisting of ethanol, isopropylalcohol, n-butanol, methanol, 1-methoxy-2-propanol, diacetonealcohol, isobutylalcohol and t-butylalcohol, and the acetate solvent is preferably selected from the group consisting of butylacetate, ethylacetate, isopropylacetate, isobutylacetate and sec-butylacetate.

The hole transport material in the composition to form the charge generating layer is preferably in the range of 5% by weight to 30% by weight based on the total weight of the composition to form the charge generating layer and comprises a substance that may be dissolved at least. 1% (w/w) relative to the organic solvent.

More preferably, the hole transport material in the composition to form the charge generating layer is an amine compound having a structure of the following formula (III):

(III)

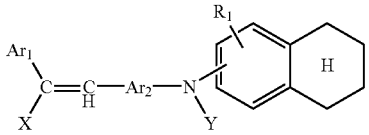

in which, $Ar_1$ is a substituted or unsubstituted aryl group;

$Ar_2$ is selected from the group consisting of a substituted or unsubstituted phenylene group, a substituted or unsubstituted naphthylene group, a substituted or unsubstituted biphenylene group and a substituted or unsubstituted anthrylene group;

$R_1$ is selected from the group consisting of a hydrogen atom, a low alkyl group and a low alkoxy group;

X is selected from the group consisting of a hydrogen atom, a substituted or unsubstituted alkyl group and a substituted or unsubstituted aryl group; and Y is a substituted or unsubstituted aryl group.

Preferably, the charge generating material in the composition to form the charge generating layer is titanyloxy phthalocyanine, and the binder resin in the composition to form the charge generating layer is polyvinylbutyral.

In accordance with another aspect of the present invention, a method that produces a multi-layered electrophotographic positively charged organic photoconductor includes:

dissolving at least one hole transport material and a binder resin in an organic solvent, followed by filtering to prepare a composition to form a charge transport layer;

mixing a binder resin and a charge generating material in an alcoholic solvent, followed by milling to form a dispersion, separately dissolving a hole transport material in an acetate solvent to form a solution and mixing the alcoholic dispersion and the acetate solution with an alcoholic solvent to prepare a composition to form the charge generating layer;

coating the composition to form the charge transport layer on a conductive substrate, followed by drying the charge transport layer; and coating the composition to form a charge generating layer on the charge transport layer, followed by drying the charge generating layer.

Here, preferably, the method may further comprise an operation of coating a composition to form an overcoat layer comprising one selected from the group consisting of polyaminoether, polyurethane and silsesquioxane on the charge generating layer that has been dried, followed by drying the overcoat layer.

Preferably, the hole transport material used to form the charge transport layer comprises at least one of a stilbene compound of the formula (I) and a hydrazone compound of the formula (II) and the hole transport material used to form the charge generating material comprises any substance that may be dissolved in a concentration of at least 1% (w/w) relative to the mixture of the alcohol solvent and the acetate solvent used. More preferably, the hole transport material used to form the charge generating material is an amine hole transport material of the formula (III).

Additional aspects and/or advantages of the invention will be set forth in part in the description which follows and, in part, will be obvious from the description, or may be learned by practice of the invention.

The coating is generally performed by ring coating or dip coating.

The multi-layered electrophotographic positively charged organic photoconductor may be utilized in an electrophotographic cartridge, an electrophotographic drum, and an image forming apparatus.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
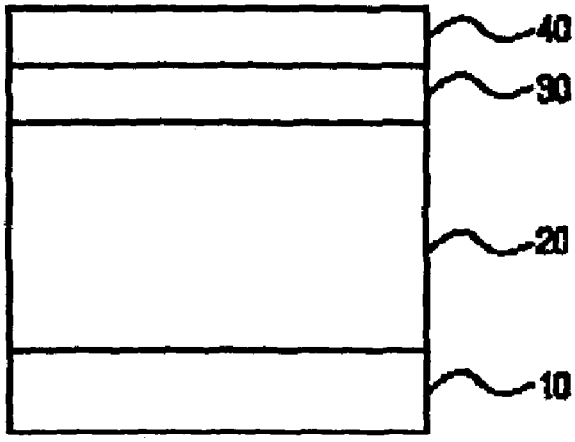
FIG. 1 (PRIOR ART)
FIG. 1 is a schematic view showing a conventional construction of a multi-layered electrophotographic positively charged organic photoconductor.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

To solve this problem, the present inventors attempted to obtain an improved interface between the charge transport layer and the charge generating layer by coating a charge generating layer comprising a solvent mixture of an alcohol solvent and an acetate solvent on a charge transport layer in another application. However, in this application, a hydrazone type hole transport material contacts a phthalocyanine type charge generating material along with polycarbonate, which has been swollen with an acetate solvent, as a binder in the composition to form a charge transport layer, since the hydrazone type hole transport material used as a hole transport material is not dissolved in an acetate solvent.

However, in this method, it is necessary to add an acetate in a large amount to the composition to form a charge generating layer, which may cause destruction of the charge transport layer due to dissolution by the acetate during dip coating. Also, upon repetition of the coating process, the coating solution of the charge generating layer may be contaminated. To solve this problem, the present inventors developed a method to facilitate the contact between a hole transport material and a charge generating material by mixing two types of hole transport materials having different solubilities in a mixture solvent of a composition to form a charge generating layer.

However, despite the inventors' efforts, as the process speed of printers increases, there are still demands for improvement in sensitivity of organic photoconductors and inhibition of the increase in the discharge voltage and the residual voltage in the repetitious electro-photographic process.

Now, the present invention will be explained in detail with reference to the accompanying drawings and examples.

The multi-layered electrophotographic positive charged organic photoconductor according to an embodiment of the present invention has a structure comprising a charge transport layer 20 and a charge generating layer 30 sequentially laminated on a conductive substrate 10, as the conventional construction of a positively charged organic photoconductor shown in FIG. 1. Typically, an overcoat layer 40 may be formed on the charge generating layer to protect the organic photoconductor. A composition to form the charge transport layer comprises at least one hole transport material, a binder resin and an organic solvent. According to an embodiment of the present invention, the hole transport material is preferably a mixture of two different compounds. Such a hole transport material is preferably a stilbene having a structure of the formula (I) or a hydrazone compound having a structure of the formula (II), with a particular preference being a mixture of the two compounds.

(I)

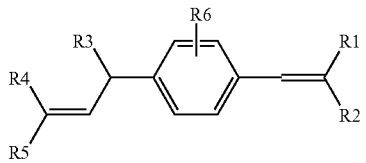

in which, R1 and R2 are independently selected from a group consisting of a hydrogen atom, an alkyl group, an aryl group and a styryl group, provided that at least one of R1 and R2 is selected from an aryl group and a styryl group;

R3 is selected from the group consisting of a substituted or unsubstituted alkyl group, an aralkyl group and an aryl group;

R4 and R5 are independently selected from a group consisting of a hydrogen atom and an alkyl group; and R6 is selected from the group consisting of a hydrogen atom, a halogen atom, an alkyl group and an alkoxy group.

(II)

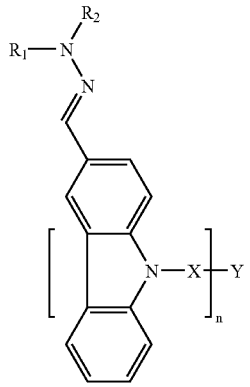

in which, n is an integer from 2 to 6;

$R_1$ and $R_2$ are independently selected from among an alkyl group, a cycloalkyl group, and an aryl group and optionally combined with the nitrogen atom to form a ring;

Y is selected from among a bond, a carbon atom, a —$CR_3$ group where $R_3$ is a hydrogen atom or an alkyl group or an aryl group, an aryl group, a cycloalkyl group, and a cyclosiloxyl group; and X is a linking group of the formula of —$(CH_2)_m$— where m is an integer from 4 to 10 and at least one methylene group is optionally substituted with an oxygen atom, a carbonyl group, or an ester group.

The stilbene compound of the formula (I) may be various compounds according to the substituents. Examples of the stilbene compound suitable for the multi-layered electrophotographic positive charged organic photoconductor according to an embodiment of the present invention are as follows:

(IV)

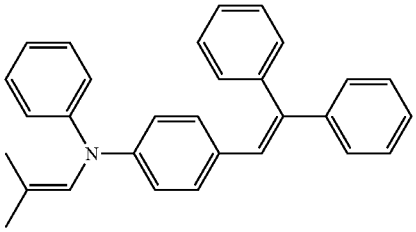

-continued (V)

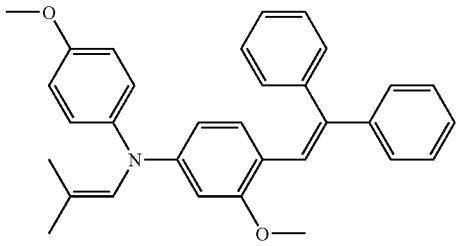

(VI)

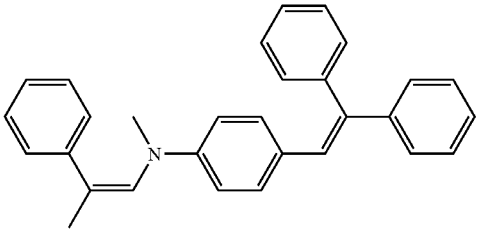

(VII)

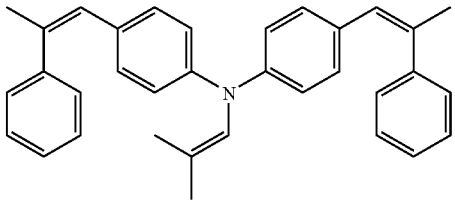

(VIII)

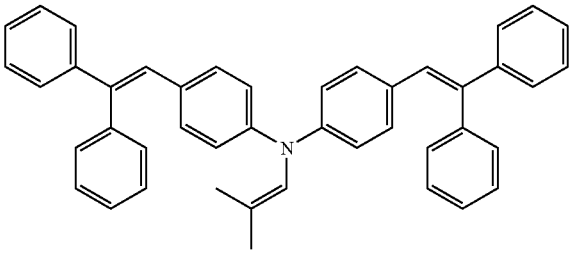

The stilbene compounds of the formulae (IV) to (VIII) are disclosed in U.S. Pat. No. 5,013,623, and synthesis of the stilbene compounds may be readily performed from the description of the patent specification.

The hydrazone compound of the formula (II) may be various compounds according to the substituents. Examples of the hydrazone compound suitable for the multi-layered electrophotographic positive charged organic photoconductor according to embodiment of the present invention are as follows:

(IX)

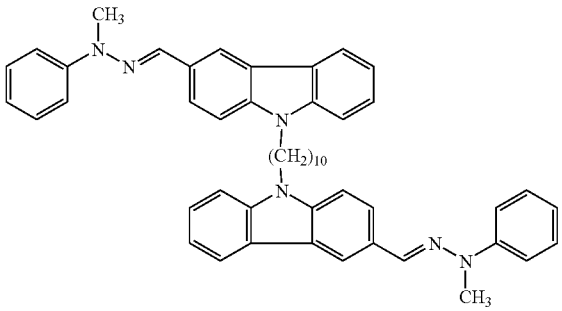

(X)

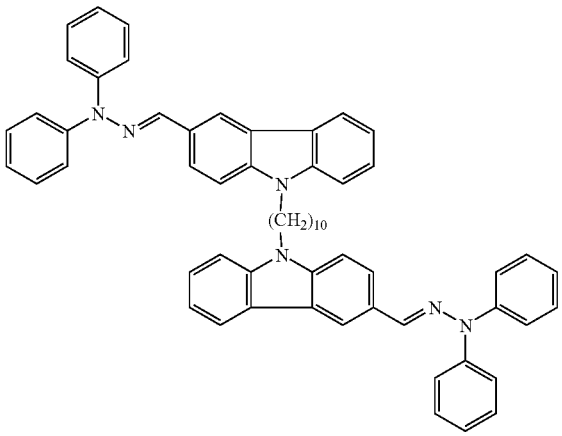

(XI)

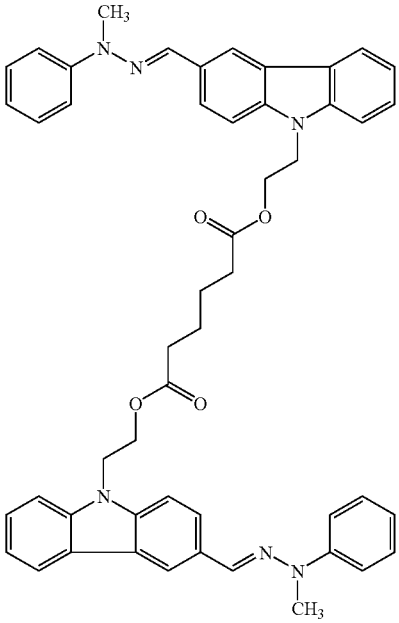

The hydrazone compounds of the formula (IX) to (XI) are disclosed in U.S. Pat. No. 6,066,426, and synthesis of the hydrazone compounds may be readily performed from the description of the patent specification.

The binder resin in the composition to form the charge transport layer is preferably polycarbonate and the organic solvent is preferably tetrahydrofuran (THF).

As the organic solvent in the composition to form the charge generating layer, a mixture of an alcohol solvent and an acetate solvent is preferably used. Specific examples of the alcohol solvent which may be suitably used in the multi-layered electrophotographic positively charged organic photoconductor according to an embodiment of the present invention include ethanol, isopropylalcohol, n-butanol, methanol, 1-methoxy-2-propanol, diacetonealcohol, isobutylalcohol and t-butylalcohol. Specific examples of the acetate solvent include butylacetate, ethylacetate, isopropylacetate, isobutylacetate and sec-butylacetate. The proportion of the acetate solvent in the mixture solvent is particularly preferably in the range of 10% by weight to 50% by weight.

One of features of the present invention is the addition of a hole transport material to the composition to form the charge generating layer. The hole transport material is added in an amount in the range of 5% by weight to 30% by weight based on the total weight of the composition to form a charge generating layer. Particularly, the hole transport material is preferably a substance that may be dissolved in a concentration of at least 1% (w/w) relative to the organic solvent in the composition to form the charge generating layer. Preferred examples of such a hole transport material are amine compounds having the following formula (III):

(III)

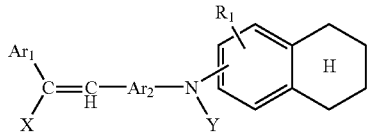

in which, $Ar_1$ is a substituted or unsubstituted aryl group;

$Ar_2$ is selected from the group consisting of a substituted or unsubstituted phenylene group, a substituted or unsubstituted naphthylene group, a substituted or unsubstituted biphenylene group and a substituted or unsubstituted anthrylene group;

$R_1$ is selected from the group consisting of a hydrogen atom, a low alkyl group and a low alkoxy group;

X is selected from the group consisting of a hydrogen atom, a substituted or unsubstituted alkyl group and a substituted or unsubstituted aryl group; and Y is a substituted or unsubstituted aryl group.

Examples of the amine compound of the formula (III) suitable for the multi-layered electrophotographic positively charged organic photoconductor according to an embodiment of the present invention are as follows:

(XII)

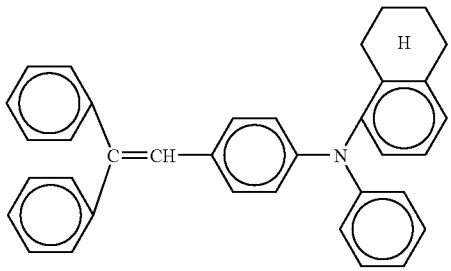

-continued (XIII)

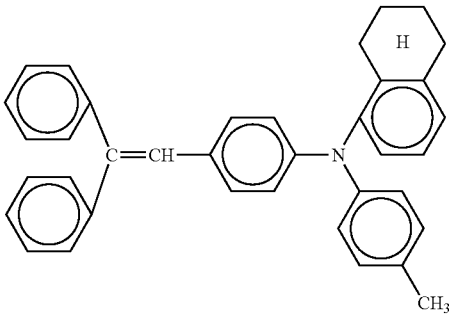

(XIV)

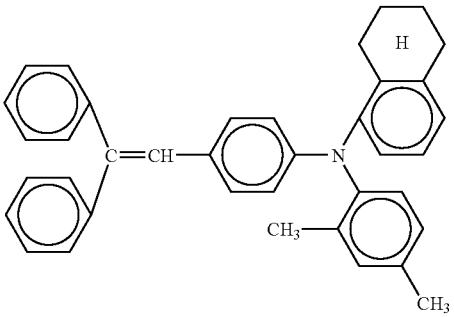

(XV)

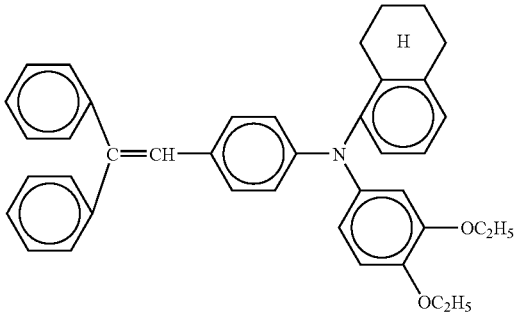

(XIVI)

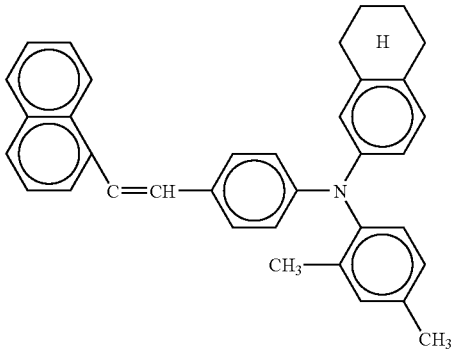

(XVII)

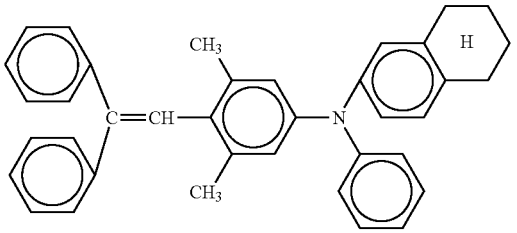

The amine compounds of the formulae (XII) to (XVII) are disclosed in U.S. Pat. No. 5,721,082, and their synthesis may be readily performed using the description of the patent specification. Also, other amine compounds illustrated in U.S. Pat. No. 5,721,082 in addition to the above compounds can be used in the present invention.

The charge generating material in the composition to form the charge generating layer is a substance to generate charge carriers by absorbing light. Examples of compounds suitable for the charge generating material in the composition to form the charge generating layer includes metal free phthalocyanine or metal phthalocyanines such as titanium phthalocyanine, copper phthalocyanine, titanyloxy phthalocyanine, hydroxygallium phthalocyanine, and titanyloxy phthalocyanine is preferably used as the charge generating material in an embodiment of the present invention.

The binder resin in the composition to form the charge generating layer preferably has an ability to disperse the charge generating material. Examples of compounds which may be used as a binder resin in an embodiment of the present invention include polyvinylbutyral, polycarbonate, polyvinylalcohol, polystyrene-co-butadiene, polyvinylacetate, styrene-alkyd resin, polyvinylchloride, polyvinylidene chloride, polyacrylonitrile, polycarbonate, polyacrylic acid, polyacrylate, polymethacrylate, styrene polymer, alkyd resin, polyamide, polyurethane, polyester, polysulfone, polyether and mixtures thereof. Particularly, polyvinylbutyral is preferred as the binder resin in an embodiment of the present invention.

Now, the method to produce the multi-layered electrophotographic positive charged organic photoconductor according to an embodiment of the present invention will be described.

First, at least one hole transport material and a binder resin are dissolved in an organic solvent and subjected to the filtration to form a composition to form a charge transport layer. The composition is coated on a conductive substrate, followed by drying. As the conductive substrate in an embodiment of the present invention, an aluminum drum may preferably be used. Coating may be performed by ring coating or dip coating. The hole transport material preferably comprises at least one of a stilbene compound of the formula (I) and a hydrazone compound of the formula (II), as described above.

Coating is generally performed by ring coating or dip coating.

Figure 2A:
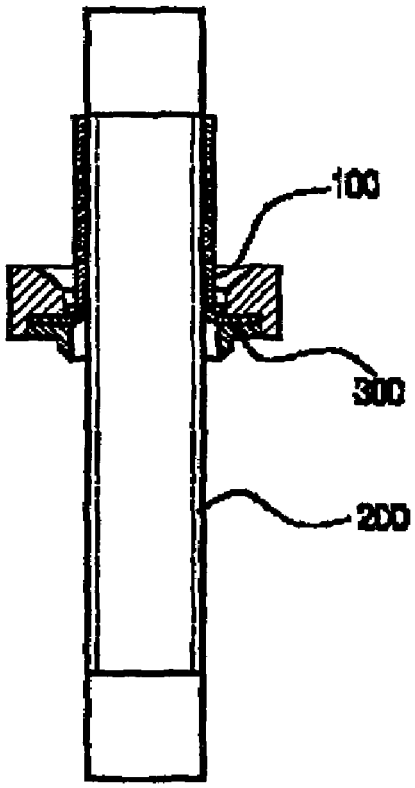
FIG. 2A is a schematic view illustrating the ring coating method to practice an embodiment of the present invention.

An Example of performing the coating by ring coating is illustrated in FIG. 2A. The ring coating to practice an embodiment of the present invention is performed as follows.

A conductive substrate 200 is fixed while a rubber ring 300 is disposed around the conductive substrate 200. As the rubber ring 300 moves in a longitudinal direction of the substrate column, a coating composition 100 is coated on the conductive substrate 200.

Figure 2B:
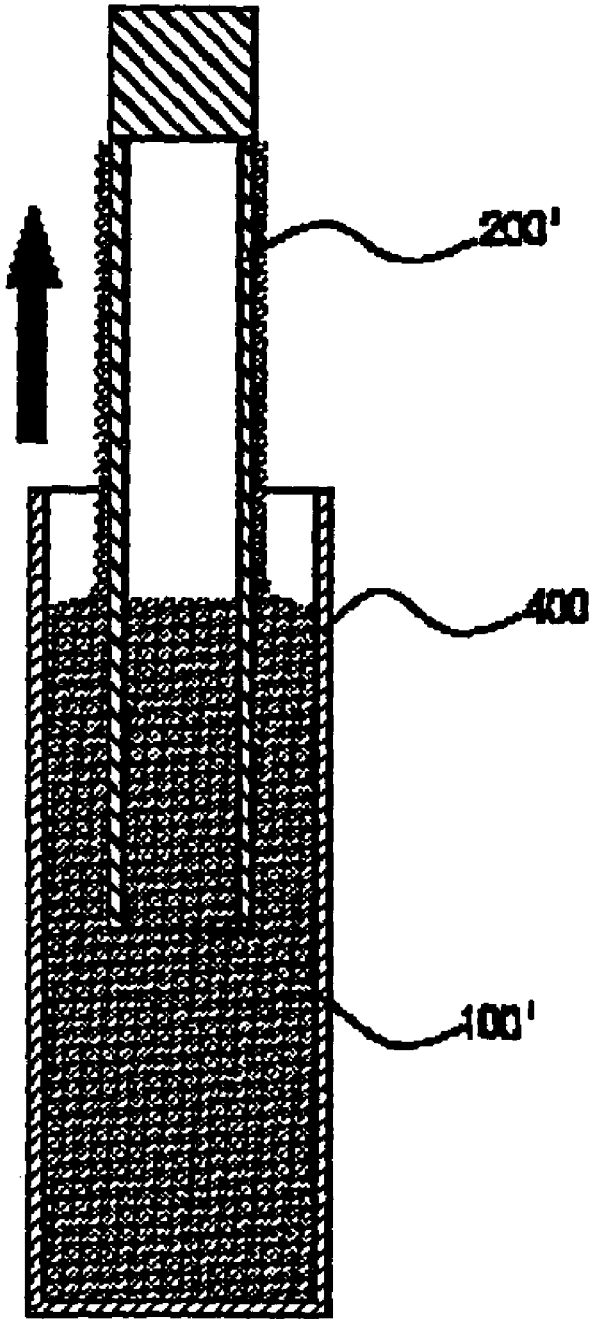
FIG. 2B is a schematic view illustrating the dip coating method to practice an embodiment of the present invention.

In FIG. 2B, an example of coating by dip coating is shown. The dip coating to practice an embodiment of the present invention is performed as follows.

A conductive substrate 200' is transported to a tank 400 containing a coating composition 100'. As the substrate is dipped into and taken out of the coating solution, the coating composition 100' is coated on the conductive substrate 200'.

For mass production of the organic photoconductor, dip coating is preferred. However, in the case of the dip coating, a part of the conductive substrate 200' which is dipped in the tank 400 at the very first, that is, the lower part, is taken out at the very last. Therefore, when the composition to form a charge generating layer is coated on the charge transport layer, the organic solvent of the coating composition may partially dissolve the underneath charge transport layer. As a result, the charge transport layer shows a change in thickness or a part of the substances forming the charge transport layer may be dissolved away, which may reduce the charge transport capacity. Also, as the coating process is repeated, there are problems including, for example, contamination of the composition to form a charge generating layer. To solve such problems, according to an embodiment of the present invention, the composition to form a charge generating layer, including a mixture solvent of an alcohol solvent and an acetate solvent, is coated on a charge transport layer. When a hydrazone compound is used alone as a hole transport material, it is seldom dissolved in an acetate solvent. Therefore, when polycarbonate is utilized as a binder in the composition to form a charge transport layer, the polycarbonate is typically swollen with an acetate solvent before it contacts a hydrazone type hole transport material and a phthalocyanine type charge generating material. However, such a process requires inclusion of a large amount of an acetate material in the composition to form a charge generating layer. The use of an acetate material in a large amount may risk of destruction of the charge transport layer by dissolution during the dip coating. Further, repetition of the coating process may cause contamination of the charge generating layer. Therefore, according to the present invention, it is preferred to use a mixture of two types of hole transport materials in a proper ratio (See examples below).

Next, a composition to form a charge generating layer is prepared. For this, first, a binder resin and a charge generating material are mixed and milled in an alcohol solvent to form a dispersion. Separately, a hole transport material is dissolved in an acetate solvent and mixed with the dispersion of the binder resin and the charge generating material to produce a composition to form a charge generating layer. The composition to form a charge generating layer thus obtained is coated on the charge transport layer previously formed on the aluminum drum and is dried to form a charge generating layer. Here, the coating is generally also performed by ring coating or dip coating.

The hole transport material added in the charge generating layer is preferably a substance that may be dissolved in a concentration of at least 1% (w/w) relative to the solvent mixture of an alcohol solvent and an and acetate solvent. According to an embodiment of the present invention, an amine compound of the formula (III) is used as the hole transport material. The hole transport material contained in the charge generating layer functions to facilitate the contact between a charge generating material and a charge transport material. As a result, charges generated by a laser beam may readily be injected into the charge transport layer.

According to an embodiment of the present invention, the organic photoconductor may further comprise an overcoat layer on the charge generating layer. The overcoat layer functions to protect the charge generating layer from friction with a toner or a cleaning blade. Examples of materials for the overcoat layer include, but are not limited to, polyaminoether, polyurethane and silsesquioxane. The coating of the overcoat layer is also typically performed by ring coating or dip coating.

Now, the present invention will be explained in detail by the following examples. However, it should be understood that the present invention is not limited thereto.

EXAMPLE 1

1.15 g of a hole transport material of the formula (V) and 1.15 g of a hydrazone compound of the formula (IX), 0.23 g of polyethyleneterephthalate copolymer (O-PET4-50, supplied by KANEBO, LTD., Japan) and 2.07 g of polycarbonate (PCZ200, supplied by MITSUBISHI CHEMCIAL CORP., Japan) were dissolved in 15.4 g of tetrahydrofuran and filtered through a filter paper with a pore size of 1 μm. Then, the filtrate was coated on an aluminum drum at a rate of 300 mm/min in a ring coating apparatus and dried in an oven at 110 C for 15 minutes to form a charge transport layer. The charge transport layer thus obtained has a thickness of about 8 μm.

Then, 0.84 g of polyvinylbutyral (BX-1, SEKISHI CO., LTD., Japan) was dissolved in 17.2 g of ethanol to obtain a solution. 1.96 g of TiOPc (titanyloxy phthalocyanine), as a charge generating material, was added the solution. The resulting solution was milled for 1 hour in an attritor type miller to obtain a dispersion. Separately, 0.08 g of a compound having a structure of the formula (XII) was dissolved in 7.68 g of butylacetate, and the resulting solution was mixed with 5.71 g of the milled dispersion previously prepared and 6.61 g of ethanol to prepare a composition to form a charge generating layer. The composition was filtered using a filter with a pore size of 5 μm. The filtrate was coated on the previously formed charge transport layer at a rate of 250 mm/min in a ring coating device and dried in an oven at 110° C. for 15 minutes to form a charge generating layer. The charge generating layer thus obtained has a thickness of about 0.3 μm.

Also, 0.2 g of polyaminoether (BLOX 205, [supplied by] DOW CHEMICAL CO.) was dissolved in 9.8 g of 1-methoxy-2-propanol. The resulting solution was coated on the previously formed charge generating layer at a rate of 200 mm/min in a ring coating device and dried in an oven at 120° C. for 20 minutes to form an overcoat layer.

Thus, a multi-layered electrophotographic positively charged organic photoconductor comprising a charge transport layer, a charge generating layer and an overcoat layer sequentially laminated on an aluminum drum is formed.

EXAMPLE 2

A multi-layered electrophotographic positively charged organic photoconductor was formed by repeating the procedure of Example 1 except that 0.16 g of a compound of the formula (XII) was used as the hole transport material to prepare the composition to form a charge generating layer.

COMPARATIVE EXAMPLE

A multi-layered electrophotographic positively charged organic photoconductor was formed by repeating the procedure of Example 1 except that a compound of the formula (XII) was not added to the composition to form a charge generating layer.

Evaluation and Result

The multi-layered electrophotographic positively charged organic photoconductors prepared in Example 1, Example 2 and the Comparative Example were measured for their charge voltages and discharge voltages, which are basic electrophotographic properties, using a charging/discharging/erasing apparatus under an evaluation condition including a linear velocity of 5.83 inch/sec and a laser power of 1.2 mW. The results are shown in Table 1 below.

TABLE 1

| | Example 1 | Example 2 | Comparative Example |
|---|---|---|---|
| Vo (V)* | 900 | 863 | 889 |
| Vd (V)** | 150 | 108 | 200 |
| $E_{1/2}$(J/cm$^2$)*** | 0.29 | 0.26 | 0.32 |

*Vo: a charge voltage
**Vd: a discharge voltage;
***$E_{1/2}$: a half discharging energy, an energy value when a surface potential becomes a half of the initial charge voltage (Vo).

As may be seen from the Table 1, upon comparison of Example 1 with Example 2, as the amount of the hole transport material in the composition to form a charge generating layer, the discharge voltage of the organic photoconductor decreased. Also, the half discharge energy was lowered, which indicates improvement of the sensitivity of the organic photoconductor.

On the other hand, the Comparative Example, in which a hole transport material is not added, showed a high discharge voltage and poor sensitivity.

As is described above, by the multi-layered electrophotographic positive charged organic photoconductor and the production method thereof according to an embodiment of the present invention, a charge generating layer may be readily coated on a charge transport layer without contamination of the charge generating layer to provide an organic photoconductor having excellent electric properties such as a low discharge voltage and residual voltage. Further, the thickness of a charge transport layer and charge generating layer may be controlled, and thus, the electrostatic properties of the organic photoconductor such as a charge voltage or discharge voltage may be controlled. In addition, since the organic photoconductor according to an embodiment of the present invention may have a thin thickness while having a high charge voltage but a low discharge voltage, the organic photoconduction may be applied in an electrophotographic development system using a wet toner having a high charge with a small particle size.

Figure 3:
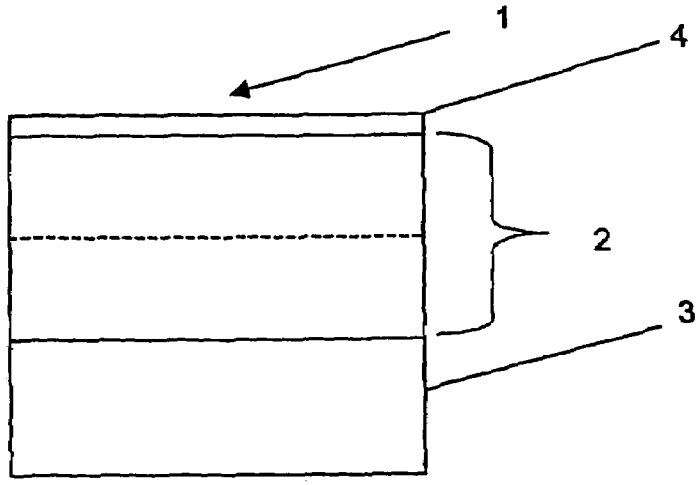
FIG. 3 is a block diagram illustrating (not to scale) an electrophotographic photoconductor installed on a conductive substrate in accordance with the present invention.

FIG. 3 is a block diagram illustrating (not to scale) an electrophotographic photoconductor 1 comprising a multiple layered positively charged organic photoconductor 2 installed on a conductive substrate 3 in accordance with an embodiment of the present invention. Where desired, the electrophotographic photoconductor may have a protective layer disposed thereon 4.

Figure 4:
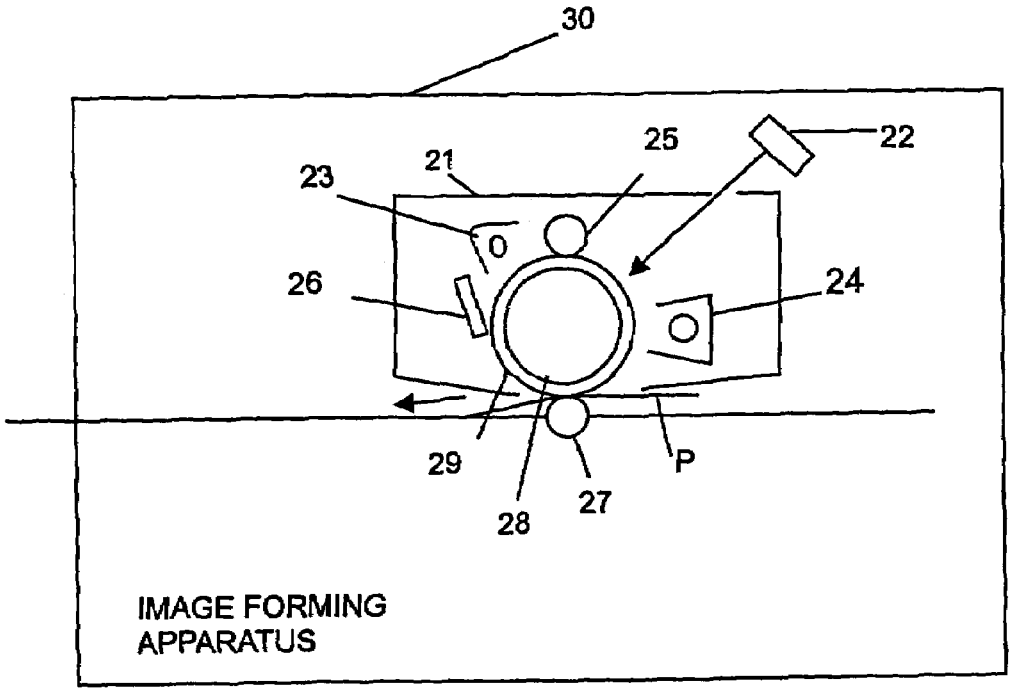
FIG. 4 is a schematic representation of an image forming apparatus, an electrophotgraphic drum, and an electrophographic cartridge in accordance with selected embodiments of the present invention.

FIG. 4 is a schematic representation of an image forming apparatus 30, an electrophotographic drum 28, and an electrophotographic cartridge 21 in accordance with selected embodiments of the present invention. The electrophotographic cartridge 21 typically comprises an electrophotographic photoconductor 29 and at least one of a charging device 25 that charges the electrophotographic photoconductor 29, a developing device 24 which develops an electrostatic latent image formed on the electrophotographic photoconductor 29, and a cleaning device 26 which cleans a surface of the electrophotographic photoconductor 29. The electrophotographic cartridge 21 may be attached to or detached from the image forming apparatus 30, and the electrophotographic photoconductor 29 is described more fully above.

The electrophotographic photoconductor drum 28, 29 (the drum 28 and the electrophotographic photoconductor 29) for an image forming apparatus 30, generally includes a drum 28 that is attachable to and detachable from the electrophotographic apparatus 30 and that includes an electrophotographic photoconductor 29 disposed on the drum 28, wherein the electrophotographic photoconductor 29 is described more fully above.

Generally, the image forming apparatus 30 includes a photoconductor unit (e.g., an electrophotographic photoconductor drum 28, 29), a charging device 25 which charges the photoconductor unit, an imagewise light irradiating device 22 which irradiates the charged photoconductor unit with imagewise light to form an electrostatic latent image on the photoconductor unit, a developing unit 24 that develops the electrostatic latent image with a toner to form a toner image on the photoconductor unit, and a transfer device 27 which transfers the toner image onto a receiving material, such as paper P, wherein the photoconductor unit comprises an electrophotographic photoconductor 29 as described in greater detail above. The charging device 25 may be supplied with a voltage as a charging unit and may contact and charge the electrophotographic receptor. Where desired, the apparatus may include a pre-exposure unit 23 to erase residual charge on the surface of the electrophotographic photoconductor to prepare for a next cycle.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A multi-layered electrophotographic positively charged organic photoconductor comprising:

a conductive substrate;

a charge transport layer on the conductive substrate; and a charge generating layer on the charge transport layer, in which a first composition to form the charge transport layer comprises:

at least one hole transport material;

a binder resin; and an organic solvent, and a second composition to form the charge generating layer comprises:

a charge generating material;

a binder resin;

an organic solvent; and a hole transport material, wherein the hole transport material in the composition to form the charge transport layer comprises a mixture of the following compounds:

a stilbene compound having a structure of the following formula (I):

(I)

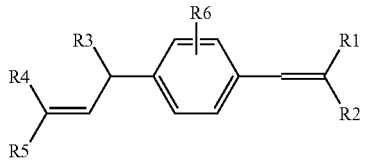

in which, R1 and R2 are independently selected from the group consisting of a hydrogen atom, an alkyl group, an aryl group, and a styryl group, provided that at least one of R1 and R2 is selected from an aryl group and styryl group;

R3 is selected from the group consisting of a substituted or unsubstituted alkyl group, an aralkyl group and an aryl group;

R4 and R5 independently selected from the group consisting of a hydrogen atom and an alkyl group; and R6 is selected from the group consisting of a hydrogen atom, a halogen atom, an alkyl group and an alkoxy group; and a hydrazone compound having a structure of the following formula (II):

(II)

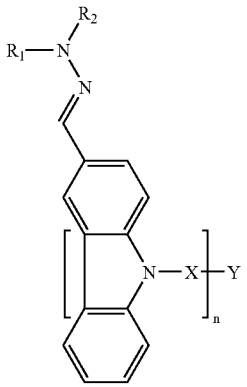

in which, n is an integer from 2 to 6;

$R_1$ and $R_2$ are independently selected from among an alkyl group, a cycloalkyl group, and an aryl group and optionally combined with the nitrogen atom to form a ring;

Y is selected from among a bond, a carbon atom, a —$CR_3$ group where $R_3$ is a hydrogen atom or an alkyl group or an aryl group, an aryl group, a cycloalkyl group, and a cyclosiloxyl group; and X is a linking group of the formula of —$(CH_2)_m$— where m is an integer from 4 to 10 and at least one methylene group is optionally substituted with an oxygen atom, a carbonyl group, or an ester group.

2. The multi-layered electrophotographic positively charged organic photoconductor according to claim 1, wherein the organic photoconductor further comprises an overcoat layer on the charge generating layer.

3. The multi-layered electrophotographic positively charged organic photoconductor according to claim 1, wherein the binder resin in the composition to form the charge transport layer is polycarbonate and the organic solvent in the composition to form the charge transport layer is tetrahydrofuran.

4. The multi-layered electrophotographic positively charged organic photoconductor according to claim 1, wherein the organic solvent in the composition to form the charge generating layer is a solvent mixture of an alcohol solvent and an acetate solvent.

5. The multi-layered electrophotographic positively charged organic photoconductor according to claim 4, wherein the solvent mixture comprises the acetate solvent in an amount of 10% by weight to 50% by weight based on a total weight of the solvent mixture.

6. The multi-layered electrophotographic positively charged organic photoconductor according to claim 4, wherein the alcohol solvent is one selected from the group consisting of ethanol, isopropylalcohol, n-butanol, methanol, 1-methoxy-2-propanol, diacetonealcohol, isobutylalcohol and t-butylalcohol and the acetate solvent is any one selected from the group consisting of butylacetate, ethylacetate, isopropylacetate, isobutylacetate and sec-butylacetate.

7. The multi-layered electrophotographic positively charged organic photoconductor according to claim 1, wherein the hole transport material in the composition to form the charge generating layer is in a range of 5% by weight to 30% by weight based on a total weight of the composition to form the charge generating layer.

8. The multi-layered electrophotographic positively charged organic photoconductor according to claim 1, wherein the hole transport material in the composition to form the charge generating layer is a substance that is soluble in an amount of at least 1% (w/w) relative to the organic solvent.

9. The multi-layered electrophotographic positively charged organic photoconductor according to claim 1, wherein the hole transport material in the composition to form the charge generating layer is an amine compound having a structure of the following formula (III):

(III)

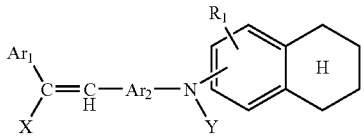

in which, $Ar_1$ is a substituted or unsubstituted aryl group;

$Ar_2$ is selected from the group consisting of a substituted or unsubstituted phenylene group, a substituted or unsubstituted naphthylene group, a substituted or unsubstituted biphenylene group, and a substituted or unsubstituted anthrylene group;

$R_1$ is selected from the group consisting of a hydrogen atom, a low alkyl group and a low alkoxy group;

X is selected from the group consisting of a hydrogen atom, a substituted or unsubstituted alkyl group and a substituted or unsubstituted aryl group; and Y is a substituted or unsubstituted aryl group.

10. The multi-layered electrophotographic positively charged organic photoconductor according to claim 1, wherein the charge generating material in the composition to form the charge generating layer is titanyloxy phthalocyanine and the binder resin in the composition to form the charge generating layer is polyvinylbutyral.

11. A multi-layered electrophotographic positively charged organic photoconductor comprising:

a conductive substrate;

a charge transport layer on the conductive substrate; and a charge generating layer on the charge transport layer, in which a first composition to form the charge transport layer comprises:

at least one hole transport material;

a binder resin; and an organic solvent, and a second composition to form the charge generating layer comprises:

a charge generating material;

a binder resin;

an organic solvent; and a hole transport material, wherein the hole transport material in the composition to form the charge transport layer comprises a hydrazone compound having a structure of the following formula (II):

(II)

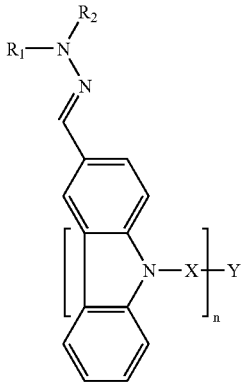

in which, n is an integer from 2 to 6;

R1 and R2 are independently selected from among an alkyl group, a cycloalkyl group, and an aryl group and optionally combined with the nitrogen atom to form a ring;

Y is selected from among a bond, a carbon atom, a —$CR_3$ group where R3 is a hydrogen atom or an alkyl group or an aryl group, an aryl group, a cycloalkyl group, and a cyclosiloxyl group; and X is a linking group of the formula of —$(CH_2)_m$— where m is an integer from 4 to 10 and at least one methylene group is optionally substituted with an oxygen atom, a carbonyl group, or an ester group, wherein the hole transport material in the composition to form the charge generating layer is an amine compound having a structure of the following formula (Ill):

(III)

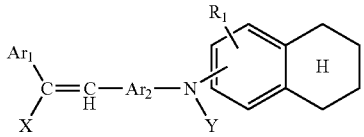

in which, $Ar_1$ is a substituted or unsubstituted aryl group;

$Ar_2$ is selected from the group consisting of a substituted or unsubstituted phenylene group, a substituted or unsubstituted naphthylene group, a substituted or unsubstituted biphenylene group, and a substituted or unsubstituted anthrylene group;

$R_1$ is selected from the group consisting of a hydrogen atom, a low alkyl group and a low alkoxy group;

X is selected from the group consisting of a hydrogen atom, a substituted or unsubstituted alkyl group and a substituted or unsubstituted aryl group; and Y is a substituted or unsubstituted aryl group.

* * * * *

UNITED STATES PATENT AND TRADEMARK OFFICE

CERTIFICATE OF CORRECTION

PATENT NO. : 7,115,346 B2 
APPLICATION NO. : 10/674786
DATED : October 3, 2006
INVENTOR(S) : Saburo Yokota et al.

It is certified that error appears in the above-identified patent and that said Letters Patent is hereby corrected as shown below:

Column 16 (Structure 1), Lines 53-62, change

" 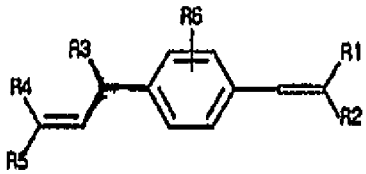

" to -- 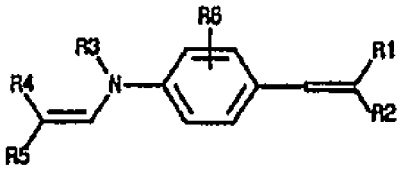

--.

Column 19, Line 25, change "R1 and R2" to --$R_1$ and $R_2$--.

Column 19, Line 30, change "R3" to --$R_3$--.

Column 20, Line 7, change "(Ill):" to --(III):--.

Signed and Sealed this

Twentieth Day of March, 2007

JON W. DUDAS
*Director of the United States Patent and Trademark Office*